United States Patent [19]

Eckstein et al.

[11] 4,290,792

[45] Sep. 22, 1981

[54] FILTER CONSTRUCTION

[75] Inventors: Wolfgang Eckstein, Sereetz; Karl-Heinz Schirk, Lübeck; Detlef Reinhold, Bad Oldeslow, all of Fed. Rep. of Germany

[73] Assignee: Drägerwerk Aktiengesellschaft, Fed. Rep. of Germany

[21] Appl. No.: 167,644

[22] Filed: Jul. 11, 1980

[30] Foreign Application Priority Data

Sep. 7, 1979 [DE] Fed. Rep. of Germany ..... 2936614

[51] Int. Cl.[3] ..... B01D 46/10

[52] U.S. Cl. ..... 55/480; 16/147; 55/422; 55/493; 55/504

[58] Field of Search ..... 55/480, 357, 493, 422, 55/504; 210/232; 16/147

[56] References Cited

U.S. PATENT DOCUMENTS

| | | | |
|---|---|---|---|
| 991,572 | 5/1911 | Weisenstein | 55/480 |
| 1,272,594 | 7/1918 | Wolter | 16/147 |
| 2,907,406 | 10/1959 | Baden et al. | 55/480 |
| 3,105,266 | 10/1963 | Flaith et al. | 16/147 |
| 3,436,860 | 4/1969 | James | 16/147 X |
| 4,002,443 | 1/1977 | Lorenz | 55/422 X |
| 4,051,205 | 9/1977 | Grant | 261/DIG. 65 |
| 4,217,122 | 8/1980 | Shuler | 55/480 |

FOREIGN PATENT DOCUMENTS

| | | |
|---|---|---|
| 1281267 | 6/1969 | Fed. Rep. of Germany . |
| 2534612 | 2/1976 | Fed. Rep. of Germany . |

*Primary Examiner*—Richard L. Chiesa
*Attorney, Agent, or Firm*—McGlew and Tuttle

[57] ABSTRACT

A filter construction particularly for vehicles and other spaces closed to the outside comprises a housing which has a filter compartment for containing the filter element with an opening to the compartment. A cover closes the opening and a locking mechanism for locking the cover in the closed position includes a slot defined in a frame portion of the housing and a lever member which is pivoted on the cover. The lever member has one arm portion with a nose which engages into the slot in the locked position and an opposite arm portion which carries a part of a bayonet joint which aligns with a complimentary part on the cover to fix the lever in the locked position. When the bayonet joint is released, the lever may be pivoted on the cover. The lever member has one arm portion with a nose which engages into the slot in the locked position and an opposite arm portion which carries a part of a bayonet joint which aligns with a complimentary part on the cover to fix the lever in the locked position. When the bayonet joint is released, the lever may be pivoted so that the nose moves out of the slot and releases the cover.

3 Claims, 4 Drawing Figures

FILTER CONSTRUCTION

FIELD AND BACKGROUND OF THE INVENTION

This invention relates in general to filter constructions and in particular to a new and useful filter and housing particularly for vehicle compartments and other spaces which are closed to the outside.

The room in the inside of vehicles for handling the exchange of used filter elements is very limited. This is particularly true for the opening of the filter housing in order to make the filter elements accessible.

Normally, the openings of filter housings are closed with covers, which are then opened and removed. Suitable constructions can be found for the covers and their gastight closures.

A known filter for cleaning air for rooms closed to the outside in its housing comprises several openings tightly sealed by covers for removal of filter units. Each cover is movably attached to the housing via two straps which are hinged both at the cover and at the housing. A closing rod, with a longitudinal slot which is tiltable and slidable is located between the straps in their support at the housing. The free end of the closing rod engages in its closing position with an ear attached to the housing. The closing rod carries a pressing screw for pressing the cover.

For opening, after release of the pressing screw, the closing rod is slid out of the ear and together with the straps the cover is turned up. The closure occurs in the opposite sequence. There are difficulties in applying this to limited space because of the sideway protrusion of the closure mechanism. Cover and closure remain with the housing and limit the accessibility during the change of the filter units. An immediate removal of loaded filter units into a protective bag is not possible. (German Pat. No. 12 81 267).

A known rapid closure for a releasable connection of a removable housing part, especially of a maintenance cover, with a stationary housing part comprises at least a gripping lever tiltably supported at one of the housing parts and one spring element prestressed by the lever and engaging the other housing part. This spring element is a leaf spring in the form of a rectangularly warped, two armed spiral spring. One arm is hung from its side on the stationary housing part toward the outside protruding, support strap, such that the end of the arm rests on the edge of the removable housing part and can press against it. The other arm which extends from the housing surface toward the outside has a connecting strap, which is hinged at the gripping lever and supported at the removable housing part. A disadvantage is that an open-position freely movable linked connection of gripping lever, connecting strap and spiral spring; the proper positioning and pressing of the closure requires both attention and the use of both hands. Operation in limited space is very difficult. For the hanging and disengaging of the spiral spring is necessary a larger free space on the side, which does not allow the arrangement of several covers in close spacing. (German Patent Application Disclosure DE-OS No. 25 34 612).

SUMMARY OF THE INVENTION

The invention provides rapid closures for releasable connections of covers for closing the maintenance openings at filter casings. They should be capable of easy handling under limited space conditions and their own space requirements may only be small.

In accordance with the invention a door is provided for a compartment of a housing which is adapted to contain a filter. The door or cover for the compartment has a locking mechanism associated with it which includes a lever which has a nose portion engageable in a slot of the housing in a locked position of the cover. The lever member may be held in the locked position by a bayonet joint construction which permits locking of an opposite arm portion of the lever so that the lever cannot pivot. When the bayonet joint is released the lever may pivot to move the nose out of the slot of the housing.

The advantageous simple solution adapts well to the space conditions. The closures are constructed exceptionally low, they can be easily handled, it is possible to operate with one hand. By way of a set screw the height of the bearing position can be adjusted without a problem. Always compensation for the yielding seal is possible. Thus the tightness important for the functioning of the filter housing is assured.

Accordingly, it is an object of the invention to provide a filter construction particularly for vehicle compartments and other spaces closed to the outside which comprises a housing having a filter compartment for containing the filter element with an opening in the housing, a removable cover for closing the opening and a locking mechanism comprising a slot defined in the housing and a lever member pivoted on the cover and having a first arm portion with a nose positionable to engage into the slot to lock the cover in place and an opposite arm portion carrying a bayonet joint part which engages with a complementary bayonet joint part on the cover to hold the lever in the locked position, the bayonet joints being disengageable to permit pivoting of the lever to an unlocked position with the nose moved out of the slot.

A further object of the invention is to provide a filter construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
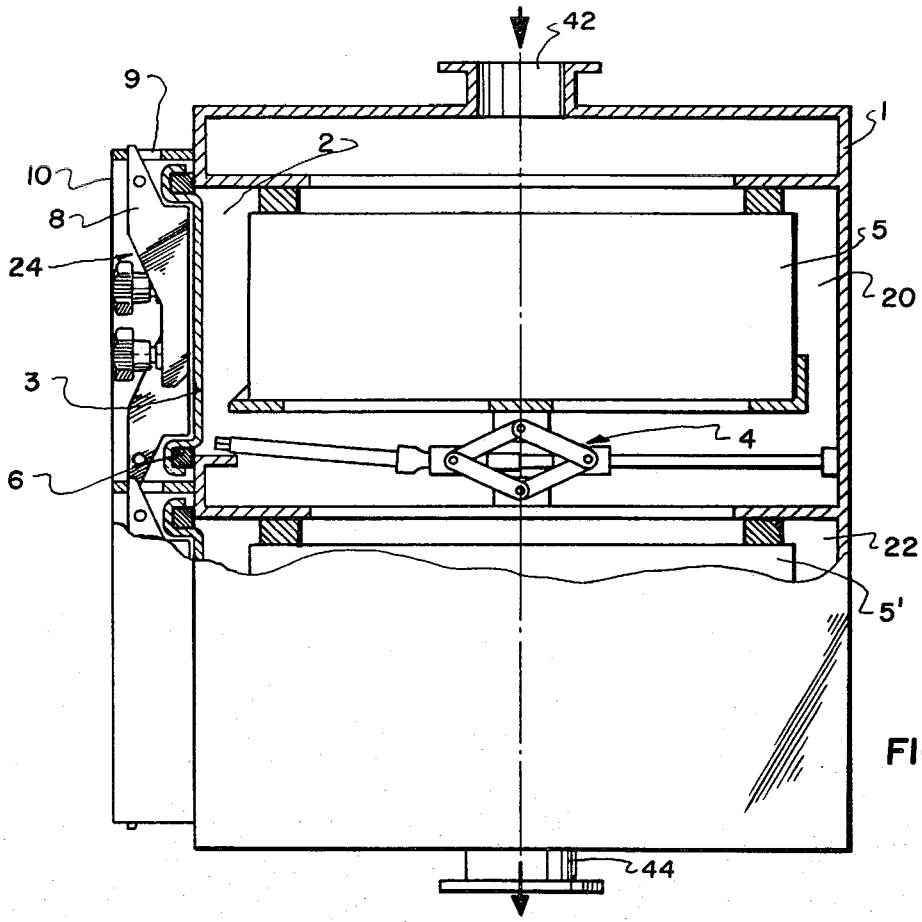
FIG. 1 is a side elevational view partly in section of a filter construction in accordance with the invention.
Figure 2:
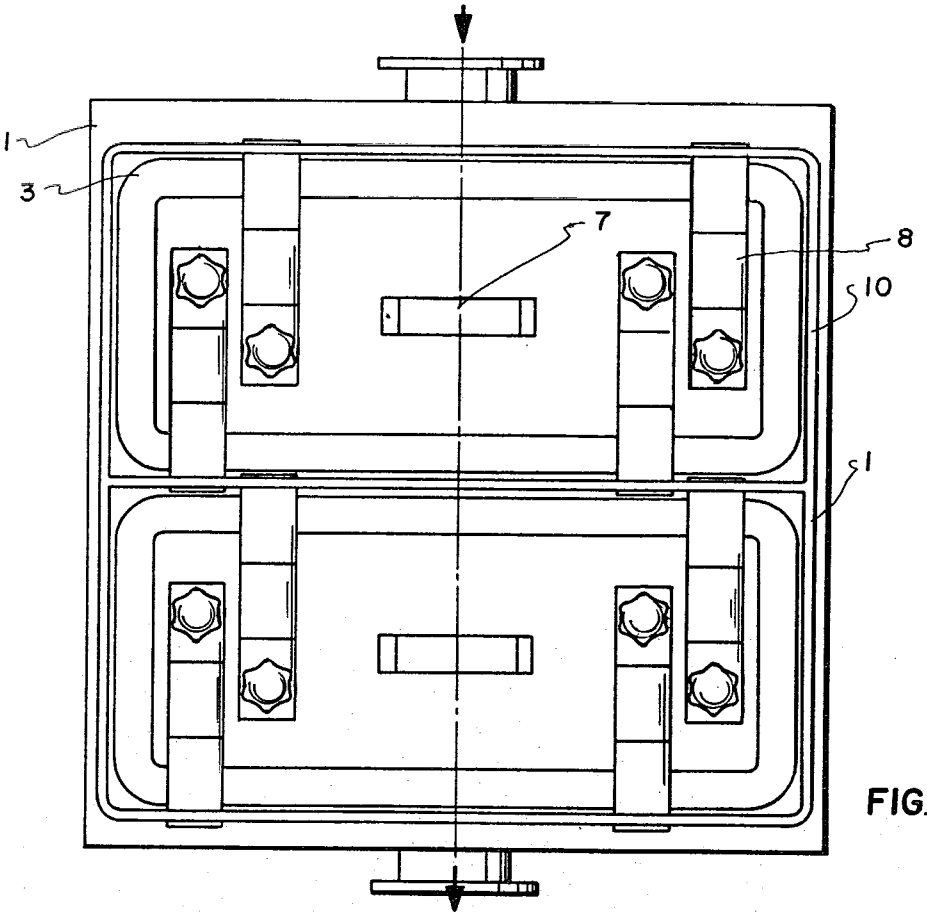
FIG. 2 is a side elevational view of the filter shown in FIG. 1.

Referring to the drawings in particular, the invention embodied therein comprises a filter housing generally designated 1 which in the embodiment shown comprises a plurality of individual filter chambers 20,22 each of which has an opening 2 which is closed by a cover member 3. Cover member 3 is removable to insert a filter element 5 which rests on attachments devices generally designated 4. In accordance with the invention each cover member 3 has a locking mechanism generally designated 24 associated therewith for locking the cover 3 in a closed position and for safeguarding that the locking mechanism will not be opened. The locking in accordance with the invention, the locking mechanism 24 includes a closure member 8 with a tiltable lever 15 member pivotally mounted on a pin 14, which is mounted in a bearing 13 mounted to the cone 3. The locking mechanism is movable between a locked position (FIG. 3) in which a nose 11 of lever member 15 extends into a slot 9 of the frame 10 of the housing 1 and to an open position as shown in FIG. 4 in which the lever member 15 is pivoted about its pivot pin support 14 to its open position. The covers 3 are sealed against filter housing one by seals 6. Each cover 3 is provided with a handle 7 to facilitate its removal after the locking mechanism is open. The frame 10 also serves as a means for holding a protective bag (not shown) which is adapted to be pulled over the loaded filter unit so that there is no risk to operating personnel.

Figure 3:
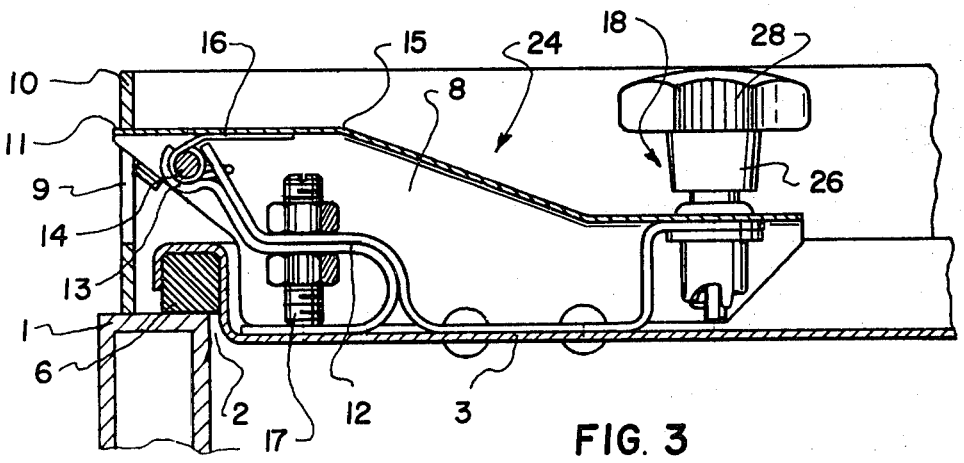
FIG. 3 is an enlarged partial sectional view showing the locking mechanism for the compartment cover in a locked position.
Figure 4:
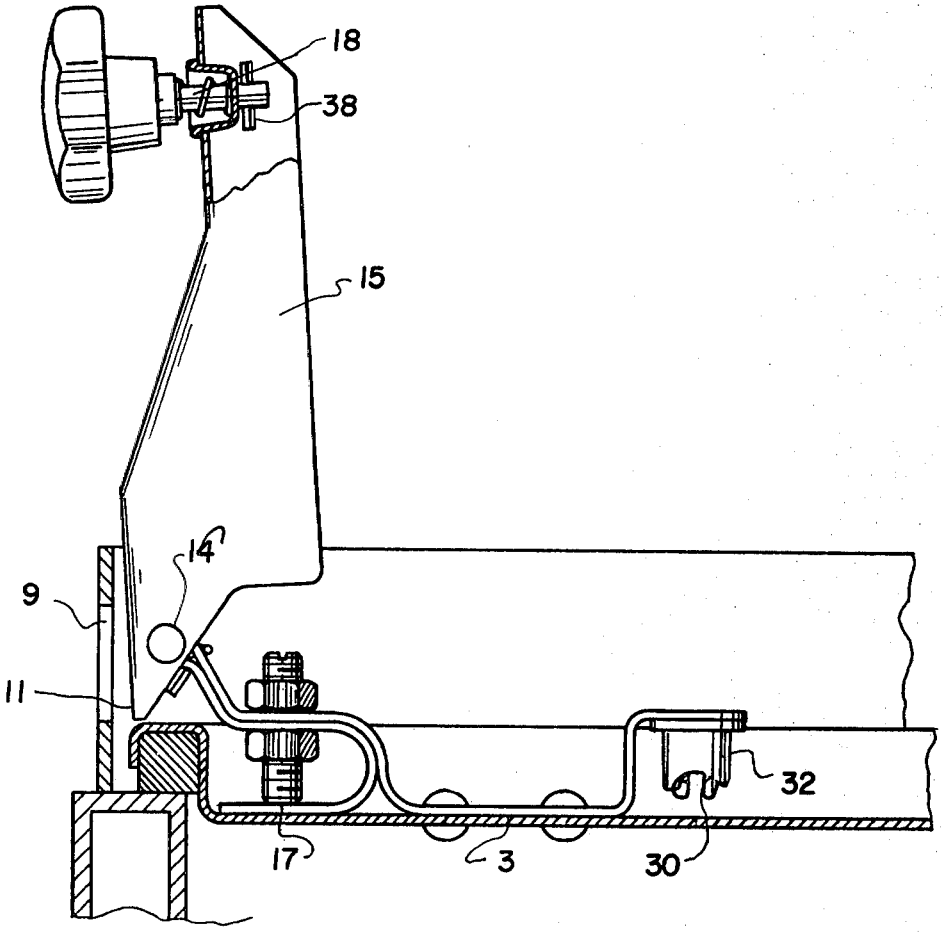
FIG. 4 is a view similar to FIG. 3 showing the locking mechanism in a open position.

As shown in the closed position of FIG. 3, nose 11 engages in the slot 9. Closure member 8 includes a pedestal 12 mounted on the cover 3. Closure member 8 carries the bearing 13 for the tiltable lever 15. A spring, resiliently urging the lever member away from the pedestal, 16 carried on the bearing 13 makes it necessary to provide a positive closing force on the lever member in order to bring the nose into the closed position. A set screw 17 is mounted on the pedestal 12 and may be rotated or threaded so as to adjust the height of the upper edge of the gripping level 15.

In accordance with another feature of the invention, coating parts define a bayonet joint between the lever member 15 and the pedestal 12. A rotatable bayonet lever portion 26 which includes a pin element 18 with a cross-pin 38 transversely mounted thereto which engages behind a locking detent 30 of a receiving socket part 32 mounted to the pedestal 12. Rotatable part 26 includes a knob handle 28. The rotation of the handle 28 will be effective to move the cross-pin 38 over a cam surface behind the detent 30 to hold the tiltable lever 15 in the locked position of FIG. 3. When the bayonet joint is released the lever 15 may be raised to the position shown in FIG. 4 in which case the nose 11 moves out of the slot 9 and frees the cover 3 from the housing 1. In the open position, the cover may be completely removed from the filter compartment.

The filter housing 1 advantageously includes a flow passage opening 42 at one side or top and a flow passage discharge 44 and any air circulating through these openings will pass through the filter elements 5, 5' etc.

While a specific embodiment of the invention has been shown and described in detail to illustrate the application of the principles of the invention, it will be understood that the invention may be embodied otherwise without departing from such principles.

What is claimed is:

1. In a filter construction, particularly for vehicle compartments and other spaces closed to the outside, of the type having a housing with a filter compartment for containing a filter element and an opening to the compartment, and a removable cover closing the opening, an improved locking arrangement comprising a slot defined in the housing, a locking mechanism including a pedestal mounted to the cover, a lever member pivotably mounted to the pedestal having a nose extendable into said slot in a locked position and being movable out of said slot when said lever member is moved to an unlocked open position, means defining a bayonet catch between said pedestal and said lever member for interengaging said lever member with said pedestal when said lever member is in the locked position and being releasable to permit pivoting of said lever member to an unlocked position which brings said nose out of the spot, and spring means for resiliently urging said lever member away from said pedestal.

2. An improved filter construction, as set forth in claim 1, further comprising a bearing mounted to the cover, a pin in said bearing pivotally supporting said lever and said spring means, and a set screw adjustably mounted to said pedestal and said bearing for adjustably moving said lever member.

3. An improved filter construction, as set forth in claim 1, wherein said bayonet catch means includes a socket part on said pedestal and a rotatable handle part on said lever member which may be rotated to lockably engage said socket part.

* * * * *